US006301736B1

(12) United States Patent
Knolle

(10) Patent No.: US 6,301,736 B1
(45) Date of Patent: Oct. 16, 2001

(54) ELEVATED SUSPENDED GUIDEWAY

(76) Inventor: Ernst G. Knolle, 2691 Sean Ct., SSF, CA (US) 94080

( * ) Notice: Subject to any disclaimer, the term of this patent is extended or adjusted under 35 U.S.C. 154(b) by 0 days.

(21) Appl. No.: 09/553,245

(22) Filed: Apr. 20, 2000

(51) Int. Cl.[7] ..... E01D 11/02; E01D 19/16; E01D 21/00

(52) U.S. Cl. ..... 14/22; 14/18; 14/23; 14/77.1

(58) Field of Search ..... 404/18, 19, 20, 404/21, 22, 23, 77.1, 78

(56) References Cited

U.S. PATENT DOCUMENTS 441,862 * 12/1890 Wildin ..... 14/19
495,621 * 4/1893 Balet ..... 14/19
510,064 * 12/1893 Eddy ..... 14/21
4,094,162 * 6/1978 Allee ..... 61/96
4,535,498 * 8/1985 Webster ..... 14/18
4,866,803 * 9/1989 Nedelcu ..... 14/19

* cited by examiner

*Primary Examiner*—Thomas B. Will
*Assistant Examiner*—Raymond W Addie

(57) ABSTRACT

Suspension cables for an elevated lightweight guideway are arranged so that high-speed traffic along the guideway is not subjected to guideway-induced oscillation. Furthermore, suspension cables are interconnected so that pre-assembled towers and guideway spans can be transported and rapidly installed by helicopter.

1 Claim, 5 Drawing Sheets

ELEVATED SUSPENDED GUIDEWAY

BACKGROUND OF THE INVENTION

The present invention relates to design and construction of lightweight elevated suspended guideways whereon high-speed vehicles will experience virtually no guideway-induced oscillations. More specifically it relates to a method of arranging suspension cables to suspend guideways along multiple towers so that deflections under vehicle load are virtually constant along the way, and temperature fluctuations do not affect alignments. Furthermore, the method of arranging suspension cables is designed to facilitate installation of pre-assembled suspension towers and pre-assembled guideway spans by helicopter.

Present multiple-span suspension bridges require anchors in alternate spans to prevent wavy rocking motion of decks and towers, thus precluding constant resilient suspension, which is necessary for oscillation-free high-speed travel.

SUMMARY OF THE INVENTION

The present invention provides structural components for an elevated suspended guideway comprising:

(a) A-frame-shaped suspension towers at regular intervals;

(b) continuous structural truss supported guideway with expansion joints at towers;

(c) above each guideway span between towers, a first tier of 32 identical inwardly sloping and upwardly extending suspension cables attached evenly spaced with their lower ends, 16 each along left and right edges, to the structural truss supporting the guideway, attaching points beginning and ending one-half space from adjacent towers, and having their upper ends attached in pairs to each other;

(d) above each guideway span between towers, a second tier of 16 identical inwardly sloping and upwardly extending suspension cables attached one each with their lower ends to the upper joints of the paired first tier suspension cables, and centrally above the guideway having their upper ends attached in pairs to each other and to their counter-parts from the opposite edge of the guideway truss;

(e) above each guideway span between towers, a third tier of four identical in vertical plane upwardly extending suspension cables having their lower ends one each attached to the upper joints of the paired second tier suspension cables, and having their upper ends attached in pairs to each other;

(f) above each guideway span between towers, a fourth tier of two identical in vertical plane upwardly extending suspension cables having their lower ends one each attached to the upper joints of the paired third tier suspension cables, and having their upper ends flexibly attached to the top of their next adjacent towers;

(g) above each guideway span between towers, cables parallel to guideway connecting the top joints of paired first, second and third tier suspension cables located nearest mid-span on one side of mid-span to their counterparts on the other side of mid-span;

(h) above each guideway span between towers, cables parallel to guideway flexibly connecting the top joints of paired first and second tier suspension cables located nearest towers to their respective next adjacent towers;

(i) above each guideway span between towers, cables parallel to guideway connecting the top joints of paired first tier suspension cables located on either side of one-quarter and three-quarter of the distance between towers to each other;

(j) motion dampers flexibly connecting guideway truss to tower legs.

The present invention is specifically directed at providing that guideway sagging under moving load is constant and fully resilient. This physical sameness is achieved by having suspension cables arranged whereby the load, irrespective of where it is located along the guideway, is substantially carried by the same type, number, size, length and position angle of suspension cables. Furthermore, this design also provides that temperature expansion and contraction does not cause guideway bending or misalignment, yet allows incorporation of horizontal and vertical curves, curve transitions, banking in curves, ascends and descends.

When used for high-speed conveyor-type automated people movers or fast freight pipelines, for example Articulated Train Systems (U.S. Pat. No. 3,320,903, Re. 26,673) or Bulk Material Conveyors (U.S. Pat. No. 4,024,947), a lightweight design would allow whole spans with suspension cables attached to be assembled at remote locations, transported to the site by helicopter and inserted between towers using quick snap-on connectors.

DETAILED DESCRIPTION OF THE INVENTION

Figure 1:
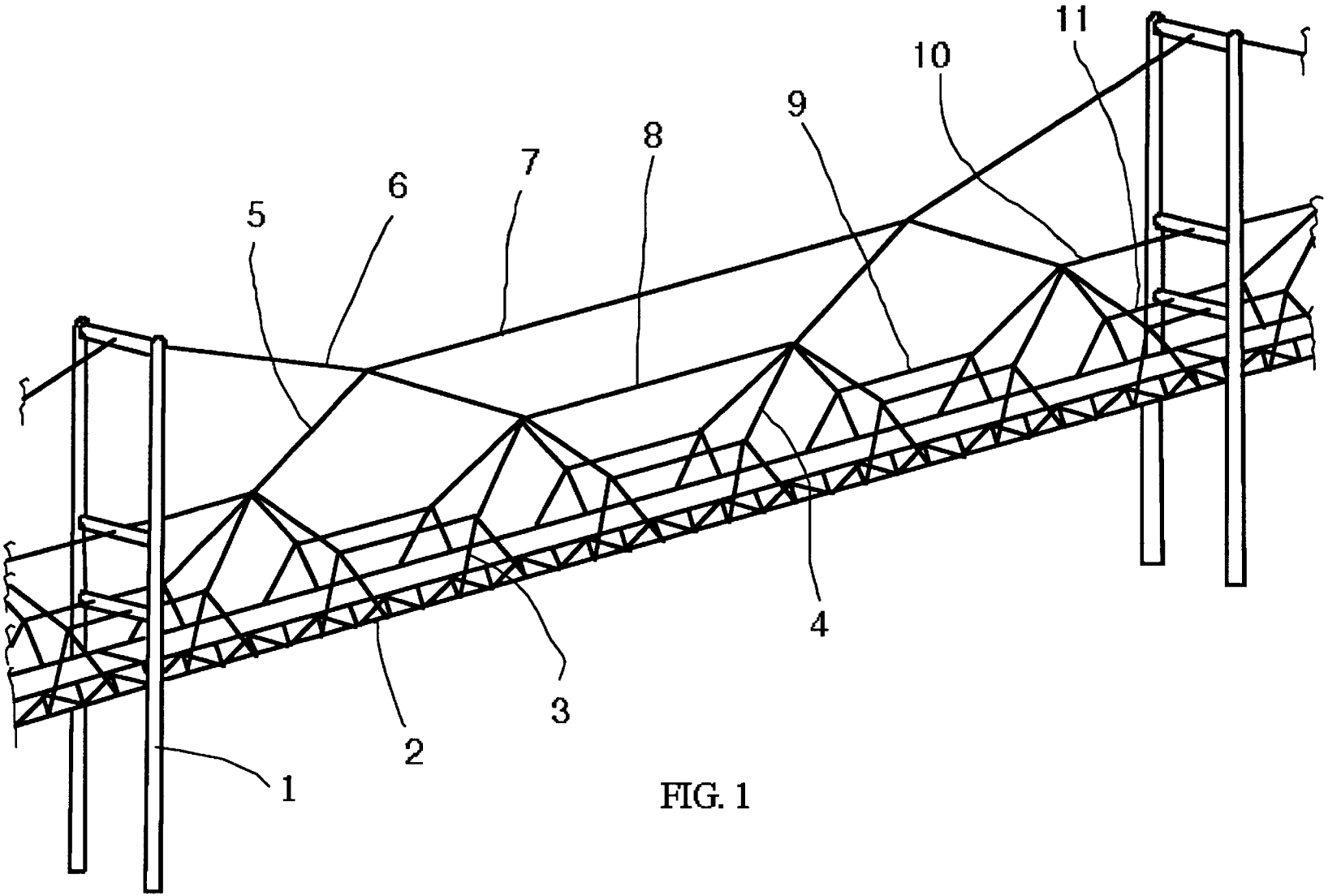
FIG. 1 is a side view of a section the suspended elevated guideway including two towers and one span.

FIG. 1 is a side view of a section of the suspended elevated guideway. Shown are two A-frame suspension towers 1, a structural truss supported guideway 2, first tier suspension cables 3, second tier suspension cables 4, third tier suspension cables 5, fourth tier flexibly connected suspension cables 6, longitudinal cables 7, 8 and 9, and flexibly connected longitudinal cables 10 and 11. Not visible are expansion joints in guideway 2 behind viewed side legs of towers 1. The height of each tier is shown here to approximate ¼ of tower height above guideway.

Figure 2:
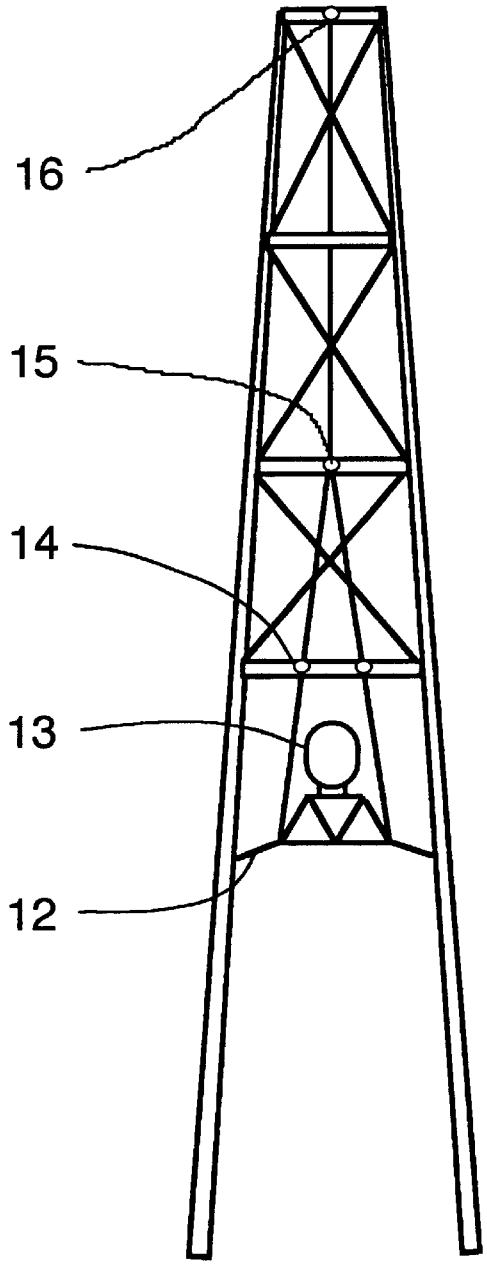
FIG. 2 shows a cross-section of the guideway with a front view of an A-frame suspension tower.

FIG. 2 is a cross-sectional view of guideway 2. Shown are motion dampers 12 holding guideway 2 centrally between legs of tower 1, a silhouette of vehicle 13 on guideway 2, attaching locations 14 for cables 11 on a cross bar of tower 1, attaching location 15 for cables 10 on a cross bar of tower 1, and attaching location 16 for fourth tier cables 6 at the top of tower 1. All connection locations in FIG. 2 are shown for towers 1 along a straight guideway 2. At locations along the way where guideway 2 is horizontally curved, attaching locations 15 and 16 are moved laterally along tower 1 cross bars in the direction away from the center of the curve in amounts depending on span length and radius of curve.

Figure 3:
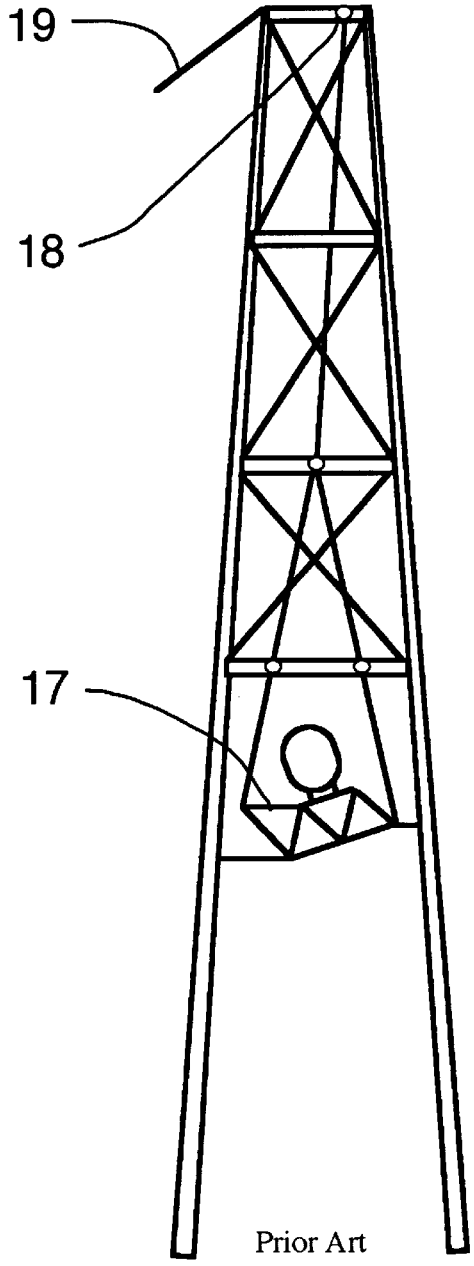
FIG. 3 shows a cross-section as in FIG. 2, except it depicts the guideway banked in a horizontal turn.

FIG. 3 is a cross-sectional view of guideway 2 similar to FIG. 2, showing tower 1 located in a banked horizontal turn. Cantilevered arms 17 are attached to guideway 2 for use by first tier suspension cables 3 to prevent them from making contact with vehicle 13 leaning into the banked turn. Fourth tier suspension cables 6 are attached to the top cross bar of tower 1 at attaching location 18, which lies on the center line of the arc of guideway 2 between towers 1. Depending on weight of vehicles travelling on guideway 2, tiebacks 19 may be added to towers 1 in tight curves.

Figure 4:
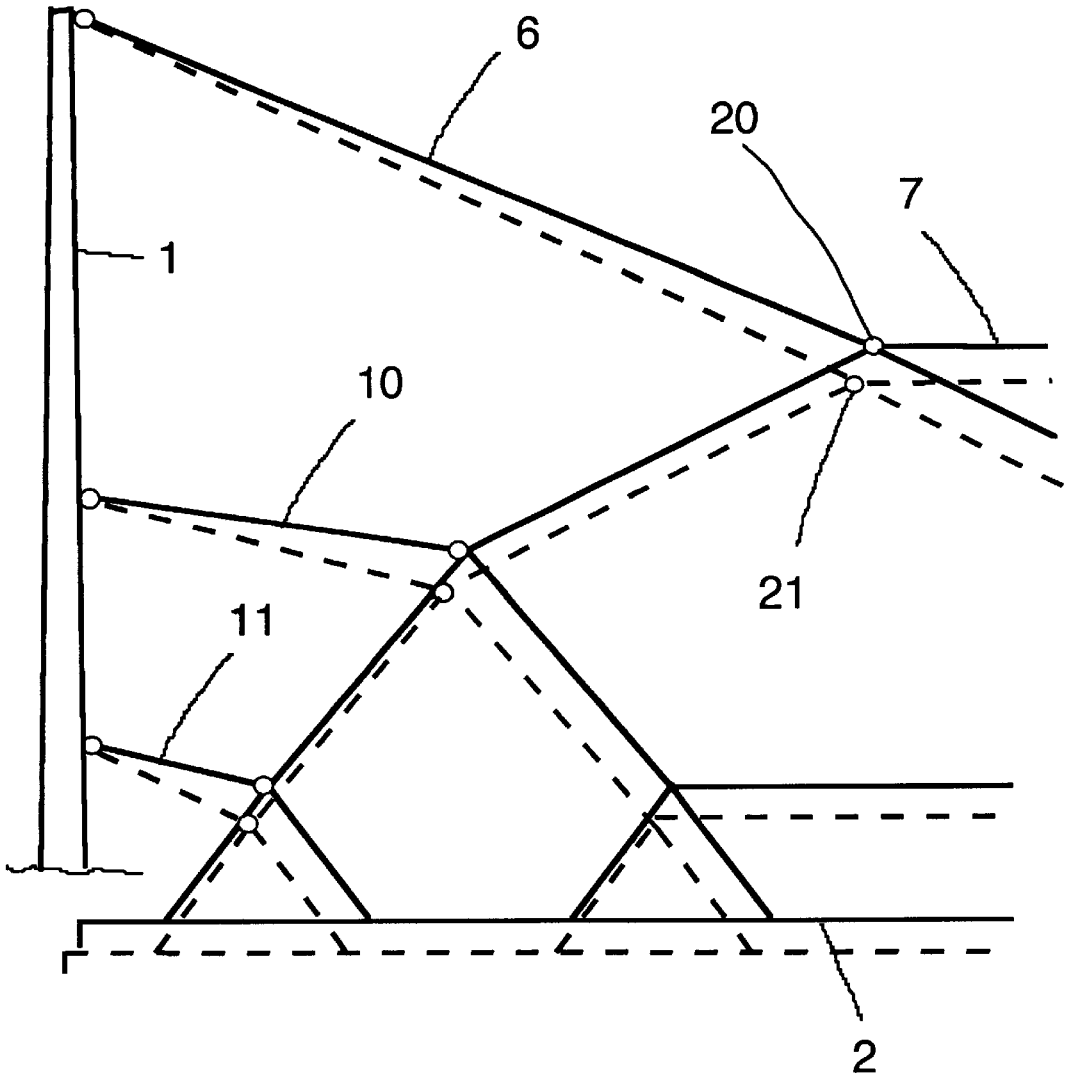
FIG. 4 is a graphic presentation of how temperature expansion and contraction lowers and raises the guideway while maintaining its longitudinal alignment.

FIG. 4 is an exaggerated graphic presentation of how temperature change affects cables connected to tower 1. Shown are cold temperature position in solid lines, and warm temperature position in dashed lines. With temperature change, fourth tier suspension cable 6 and longitudinal cable 7 combine to raise and lower guideway 2. All other cables expand and contract with the guideway in unison. Thus, do not disturb the guideway's relative alignment.

As an example, assuming all components are made of steel with similar temperature expansion factors, spans are 160 feet (50 m) long and towers 80 feet (25 m) high. If the design temperature range is from −50 F. to +120 F. (−47 C. to +49 C.), then the coldest connection location 20 between fourth tier suspension cable 6 and lateral cable 7 would move to the hottest connection location 21, which is a movement to the left by 0.67" (1.70 cm) and a lowering by 3.67" (9.3 cm). Guideway 2 would drop uniformly by the same amount, and lateral cables 10 and 11 would rotate around their tower attaching points, similarly to that of fourth tier suspension cable 6. All other components of the span would expand directly proportional away from he center of the span, which remains in fixed location.

Figure 5:
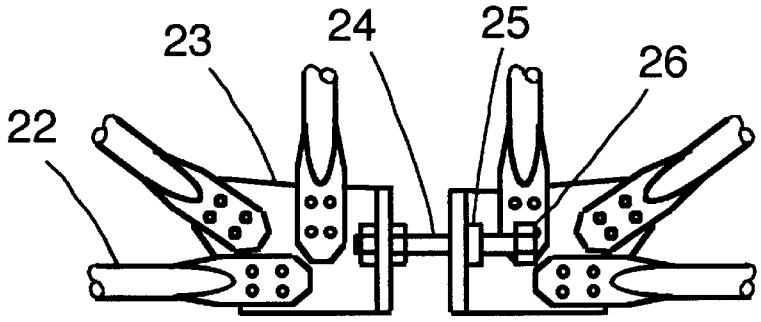
Prior Art FIG. 5
FIG. 5 shows a typical guideway expansion joint located at each tower.

FIG 5 shows a typical expansion joint between adjacent truss supports of guideway 2. Structural members 22 are held together by gussets 23 with lateral flanges to which machined bolt 24 is attached to one truss section and in sliding engagement with a bushing 25 attached to a counterpart of its adjacent truss section. Machined bolts 24 have sufficiently length to permit guideway 2 thermal expansions and contractions, which, with the assumption detailed for FIG. 4 above would come to 2.7" (6.8 cm). Bolt heads 26 would prevent accidental disconnection of expansion joints. For cross-section of guideway 2, as shown in FIGS. 2 & 3, there would be 5 expansion joints as shown in FIG. 5 at each tower 1. Dampers may be added to limit motion in expansion joins to those caused by temperature change.

Figure 6:
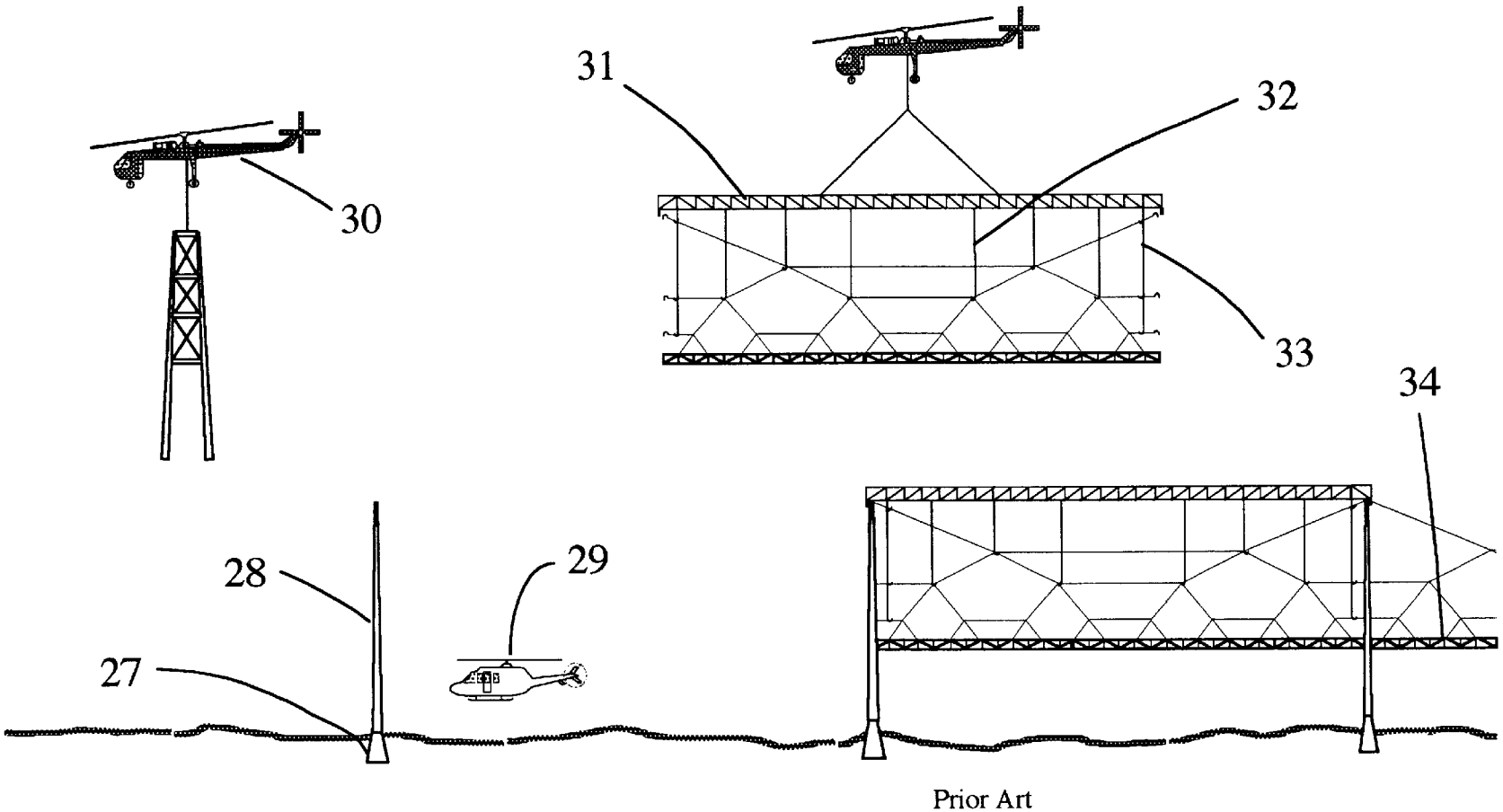
FIG. 6 shows construction of towers and guideway by helicopter.

FIG. 6 depicts the general method of erecting the suspended elevated guideway using helicopters. After surveying and clearing the route, concrete tower footings 27 are poured and allowed to cure. A-frame towers 28 are secured to footings 27 by ground crews brought in by small helicopter 29. Large helicopters 30 carry pre-assembled towers 1 and guideway 2 spans from assembly location to erection site. Suspended from helicopter 30 is a load spreader 31 with four hooked carrying straps 32 attached to the upper joints of second tier suspension cables 4. Hooked hanging straps 33 are merely holding the loose cables 6, 10 and 11 in readiness for hookup to their respective towers 1. At the erection site, guideway 2 is lowered into place until spreader 31, which is longer than the span between towers 1, comes to rest with its front and rear end on top of towers 1, at which time helicopter 30 disconnects and returns for its next load. The ground crew connects suspension cables 6 and lateral cables 10 and 11 to towers 1, and guideway 2 to the previously installed guideway 34 using vertical adjusting means incorporated in carrying straps 32 to achieve proper alignment. To prevent newly connected towers 1 from bending under uneven load, spreaders 31 remain and support the weight of guideways 2 until the next following span is added.

High tension electric power line construction experience has shown that heavy lifting helicopters 30 can make about 60 trips per day when the assembly location is not more than 5 miles (8 Km) away. On that scale, the here-described methodology could achieve a construction rate of one-mile (1.6 Km) per day. Lifting capacity of these helicopters 30 is in excess of 10 tons. A 160 feet (50 m) long, 5 by 5 feet (1.5×1.5 m) cross-section aluminum spreader 31 would weigh about 3 tons, and an equally lightly constructed guideway 2 may weigh 4 tons, for a total of 7 tons.

Figure 7:
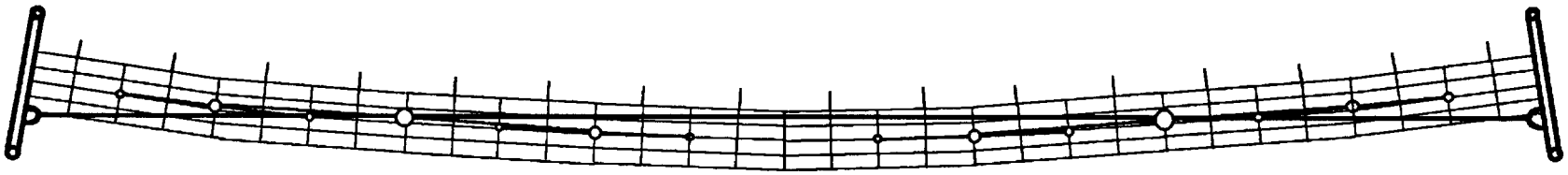
Prior Art FIG. 7
FIG. 7 is a plan view of a typical span containing a horizontal curve.

FIG. 7 is a plan view of a guideway 2 span containing a horizontal curve. Fourth tier suspension cables 6 and longitudinal cable 7 are shown in heavy outline. They are located on the centerline of the arc of the span of guideway 2. For curved spans with equal radii, attaching points 18 of fourth tier suspension cables 6 are located opposite each other on the top cross-bar of towers 1, and their horizontal components of cable tension cancel each other out. However, in guideway 2 horizontal curvature transitions from straight-line to curved, between curves of different radii or S-curves, attaching points 18 of fourth tier suspension cables 6 are not located opposite each other on the top cross-bar of towers 1. For high-speed guideways 2, such transitions would take place over several spans and the opposite attaching point 18 discrepancy in each span would be minimal. A simple solution would be to have fourth tier suspension cables 6 split in two near the top of towers 1 and attached to the top cross bar at spaced apart locations.

The sameness of suspension achieved by this design can be demonstrated with a graphical force analysis at each junction point of the suspension cables. However in principle, since a horizontal cable cannot transmit a vertical force, an incremental increase in cable tensions due to a vehicle with weight W on guideway 2 must necessarily travel only upwards, from guideway 2 through first, second, third and fourth tier suspension cables to the top of towers 1. Thus, incremental tension increase $F_x$ in each tier suspension cable due to weight W amounts to:

$$F_x = W/\cos \alpha_x,$$

where $\alpha$ is the angle between cable direction and vertical, and x the tier number.

Assuming FIG. 1 is drawn to scale, then approximate angles between cable directions and vertical are, first tier $\alpha_1=38°$, second tier $\alpha_2=42°$, third tier $\alpha_3=63°$ and fourth tier $\alpha_4=67°$. If weight W is acting at the lower end of any first tier cable 3, incremental tension increases in cables directly above due to weight W are, in first tier 1.27 W, in second tier 1.35 W, in third tier 2.20 W and in fourth tier 2.56 W. Force diagrams also show that incremental tension increases $F_{horiz}$ occur in horizontal cables 7 and 8 due to weight W. The magnitudes of $F_{horiz}$ depend on location of weight W as follows:

(a) In horizontal cable 7 when weight W is in span portion:
First and fourth quarter $F_{horiz}=W(\tan \alpha_3+\tan \alpha_4)$,
Second and third quarter: $F_{horiz}=W(\tan \alpha_4-\tan \alpha_3)$ (b) In horizontal cable 8 when weight W is in span portion:
First and fourth quarter: $F_{horiz}=0$,
Third and sixth eighth: $F_{horiz}=W(\tan \alpha_2+\tan \alpha_3)$,
Fourth and fifth eighth: $F_{horiz}=W(\tan\alpha_3-\tan \alpha_2)$.

Using above measured angles, incremental tension increase in horizontal cable 7 ranges from 0.39 W to 4.32 W, and in horizontal cable 8 from zero to 2.86 W. Incremental tension increases $F_{horiz}$ due to vehicle weight W in one half of the span travel via horizontal cables 7, 8 and 9 across mid-span to the other half of the span, redistributing themselves there in reverse order and causing lifting forces to act on guideway 2. To prevent these lifting forces from inducing seesaw-rocking motions of guideway 2 spans in the wake of intermittently passing vehicles 13, guideway 2 must be tied down at each tower 1 by cables attached with their lower ends to the legs of towers 1. With a tension spring in parallel with a damper inserted in each tie-down cable at towers 1, there would also be automatic length adjustment when guideway 2 spans rise and fall with temperature change.

What is claimed is:

1. A device for suspending a continuous elevated suspended guideway along evenly-spaced towers by suspension means which enable vehicles moving along guideway to experience virtually no rhythmic unevenness in guideway alignment and sagging under load. Such suspension means include four tiers in series connected suspension cables, in ascending order a first tier of 32 cables, a second tier of 16 cables, a third tier of 4 cables and a fourth tier of 2 cables, together with horizontal cables being located and connected as follows:

(a) above each guideway span between towers, a first tier of identical 32 inwardly sloping and upwardly extending suspension cables being attached with associated lower ends being evenly spaced, said guideway having 16 suspension cables along each of a left and right edge, to a structural truss supporting the guideway, attaching points beginning and ending one-half space from adjacent towers, and having their upper ends attached in pairs to each other;

(b) above each guideway span between towers, a second tier of 16 identical inwardly sloping and upwardly extending suspension cables attached one each with their lower ends to the upper joints of paired first tier suspension cables, and centrally above the guideway having their upper ends attached in pairs to each other and to their counter-parts from the opposite edge of the guideway truss;

(c) above each guideway span between towers, a third tier of four identical in vertical plane upwardly extending suspension cables having their lower ends one each attached to the upper joints of paired second tier suspension cables, and having their upper ends attached in pairs to each other;

(d) above each guideway span between towers, a fourth tier of two identical in vertical plane upwardly extending suspension cables with their lower ends one each attached to upper joints of paired third tier suspension cables, and their upper ends flexibly attached to the top of respective next adjacent towers;

(e) above each guideway span between towers, cables parallel to guideway connecting the top joints of paired first, second and third tier suspension cables located near mid-span on one side of mid-span to their counterparts on the other side of mid-span;

(f) above each guideway span between towers, cables parallel to guideway connecting the top joints of paired first and second tier suspension cables located nearest towers to their respective next adjacent towers;

(g) above each guideway span between towers, cables parallel to guideway connecting the top joints of paired first tier suspension cables located on either side of one-quarter and three-quarter distance between towers to each other;

(h) motion dampers flexibly connected between guideway and tower legs;

(i) resilient alignments maintaining structural truss support for the guideway.

* * * * *